US008245638B2

(12) United States Patent
Petersen

(10) Patent No.: US 8,245,638 B2
(45) Date of Patent: Aug. 21, 2012

(54) METHOD FOR ALIGNING COLOR SEPARATIONS OF A PRINTING IMAGE ON A PRINTING MATERIAL

(75) Inventor: Ralph Petersen, Luetjenburg (DE)

(73) Assignee: Eastman Kodak Company, Rochester, NY (US)

( * ) Notice: Subject to any disclaimer, the term of this patent is extended or adjusted under 35 U.S.C. 154(b) by 966 days.

(21) Appl. No.: 11/568,736

(22) PCT Filed: Apr. 26, 2005

(86) PCT No.: PCT/EP2005/004458

§ 371 (c)(1),
(2), (4) Date: Oct. 26, 2007

(87) PCT Pub. No.: WO2005/109112

PCT Pub. Date: Nov. 17, 2005

(65) Prior Publication Data

US 2008/0115679 A1 May 22, 2008

(30) Foreign Application Priority Data

May 6, 2004 (DE) ..... 10 2004 023 041

(51) Int. Cl.
*B41F 13/12* (2006.01)
*B41F 13/14* (2006.01)
*B41F 1/34* (2006.01)

(52) U.S. Cl. ..... 101/485; 101/211; 101/481; 101/484; 101/486

(58) Field of Classification Search ..... 101/171, 101/180–181, 183, 248, 481, 484–486, 211
See application file for complete search history.

(56) References Cited

U.S. PATENT DOCUMENTS

| | | | | |
|---|---|---|---|---|
| 5,384,592 | A * | 1/1995 | Wong | 347/116 |
| 5,627,649 | A | 5/1997 | Sawayama et al. | 358/296 |
| 6,682,163 | B2 | 1/2004 | Metzler et al. | 347/19 |
| 7,032,519 | B2 | 4/2006 | Luxem et al. | 101/485 |
| 2003/0002891 | A1 * | 1/2003 | Metzler et al. | 399/301 |

FOREIGN PATENT DOCUMENTS

| | | |
|---|---|---|
| DE | 962 166 | 4/1957 |
| DE | 3731914 A1 | 4/1989 |
| DE | 4218761 C2 | 12/1993 |
| EP | 0123305 A2 | 10/1984 |
| EP | 0598566 B1 | 6/1998 |
| EP | 0930772 A2 | 7/1999 |
| EP | 1087612 B1 | 11/2004 |

* cited by examiner

*Primary Examiner* — Daniel J Colilla
*Assistant Examiner* — Marissa Ferguson Samreth
(74) *Attorney, Agent, or Firm* — Lawrence P. Kessler; Christopher J. White

(57) ABSTRACT

Color separations of a printing image are aligned on a printing material perpendicular to the transport direction of the printing material. A front edge and a rear edge of a register mark are detected. Their distances and, at least in some regions, their widths along the traveled distance of the transport belt between the detection of the front edge and of the rear edge of the register mark are determined. Misalignments of the imaging devices used for the color separations are determined and corrected using these distances and widths.

11 Claims, 2 Drawing Sheets

METHOD FOR ALIGNING COLOR SEPARATIONS OF A PRINTING IMAGE ON A PRINTING MATERIAL

FIELD OF THE INVENTION

The invention relates to a method for aligning color separations of a printing image on a printing material which is transported along a transport path in a direction perpendicular to the transport direction of the printing material, in which case at least one register mark is initially applied to the printing material for each color separation, the positions of the register marks are detected in the direction perpendicular to the transport direction, and misalignments of the imaging devices used for said color separations are determined and corrected.

BACKGROUND OF THE INVENTION

In color printing machines, a printed image is created on a printing material by superimposing several color separations. If the color separations are not exactly registered on the printing material, these deviations are well-visible in the printed image and hence represent a quality defect.

The color printing machine may be an offset printing machine, in which the color separations are created by different printing plates. To accomplish this, each of the colors is assigned its own type form, e.g., a printing plate.

The color printing machine, however, may also be an ectrophotographic printing machine. This printing machine may comprise a separate printing unit for each color separation. By using imaging devices, which may include, for example, lines (rows) or matrices (arrays) of laser diodes or LEDs, a latent image is generated on an imaging web or on an imaging cylinder. Depending on the printing unit, this image is associated with a specific color.

Toner of the appropriate color may be applied to the imaging cylinder. The resultant toner image corresponds to the latent image on the surface of the imaging cylinder.

Depending on the type of printing machine, the design may provide that the toner adheres only to the exposed areas of the printing cylinder or only to the unexposed areas of the printing cylinder.

Depending on the type of printing machine, the toner may be applied directly from the imaging cylinder to the printing material, e.g., paper, or this step may take place by means of an interposed transfer material means, a rubber blanket cylinder or a transfer belt. In so doing, a corresponding color separation is created on the printing material.

Furthermore, printing machines have been known, in which one printing unit produces each color separation. It is also possible that various color separations are first printed on top of each other on a transfer means, such as a transfer belt, and are then transferred from this transfer means to the printing material in one step.

Depending on the alignment of the imaging devices or depending on the adjustment of their respective zero positions, or even other error sources not mentioned here, it may happen that individual color separations are not superimposed exactly, not registered accurately, on the printing material, as would be desirable for the resultant printed image. These positional deviations of the color separations from their set positions may occur, in particular, in a direction perpendicular to the transport direction of the printing material. Hereinafter, this direction will also be referred to as the scanning direction or X-direction, because this is a direction which can be associated with the advance direction, i.e., the scanning direction of an imaging device. The imaging device scans the surface of a printing plate or an imaging cylinder in axial direction, while said plate or cylinder rotate under it, thereby permitting the desired printing image to be applied to their surfaces.

In order to avoid quality reductions of the printed image caused, in particular, in scanning direction due to the positional deviation of the color separations, for example, U.S. Pat. No. 5,384,592 to Wong has disclosed the application of register marks on the printing material.

U.S. Pat. No. 5,384,592 to Wong suggests two alignment indicators consisting of two register marks comprising lines that are inclined parallel to each other, and in which case each register mark has a front line and a rear line extending perpendicularly in transport direction. In so doing, the register marks are applied in the shape of triangles. A sensor measures the times at which the front line and the rear line, respectively, and the two parallel inclined lines pass through the sensor. The difference between the measured times is then used to compute the focus of the alignment indicators. With the knowledge of the measured foci of the alignment indicators for various color separations, deviations of the color separations can be corrected. In particular, the alignment indicators described in this reference provide that two alignment indicators are always created in one line perpendicular to the transport direction of the printing material on different sides of an image zone of the printing material. This is intended to also allow the detection of position errors of the color separations in the direction of the transport path of the printing material. Essential elements of the method described in this reference are that the foci of the alignment indicators must be detected; therefore, a uniform transport speed of the printing material must be ensured. Irregularities in the transport speed can result in measurement errors. Furthermore, in particular, lines of alignment indicators perpendicular to the transport direction and diagonal parallel lines that are inclined relative to the former are necessary. Poor positioning of the imaging devices, which could result in inclined positions of the alignment indicators, can result in errors such as unwanted enlargements of individual picture elements caused, e.g., by optical element errors, when the alignment indicators are analyzed. If an enlargement occurs, for example, the parallel arrangement of the inclined lines is no longer absolutely given.

SUMMARY OF THE INVENTION

The object of the present invention is the development of a process for aligning color separations on a printing material in a direction transverse to the transport direction of the printing material, said method being at least more independent of potential irregularities of the transport speed of the printing material.

In accordance with the invention, this object is achieved by a method for aligning color separations of a printing image on a printing material, which is transported along a transport path in a direction perpendicular to the transport direction of the printing material, in which case at least one register mark is initially applied to the printing material for each color separation, the positions of the register marks are detected in the direction perpendicular to the transport direction, and misalignments of the imaging devices used for said color separations are determined and corrected, in which case a front edge and a rear edge of a register mark are detected by a sensor, and their distances from each other, and, at least in some areas, the width of the register mark along the distance passed by the transport belt is determined between the detection of the front edge and the rear edge of the register mark.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

Figure 1:
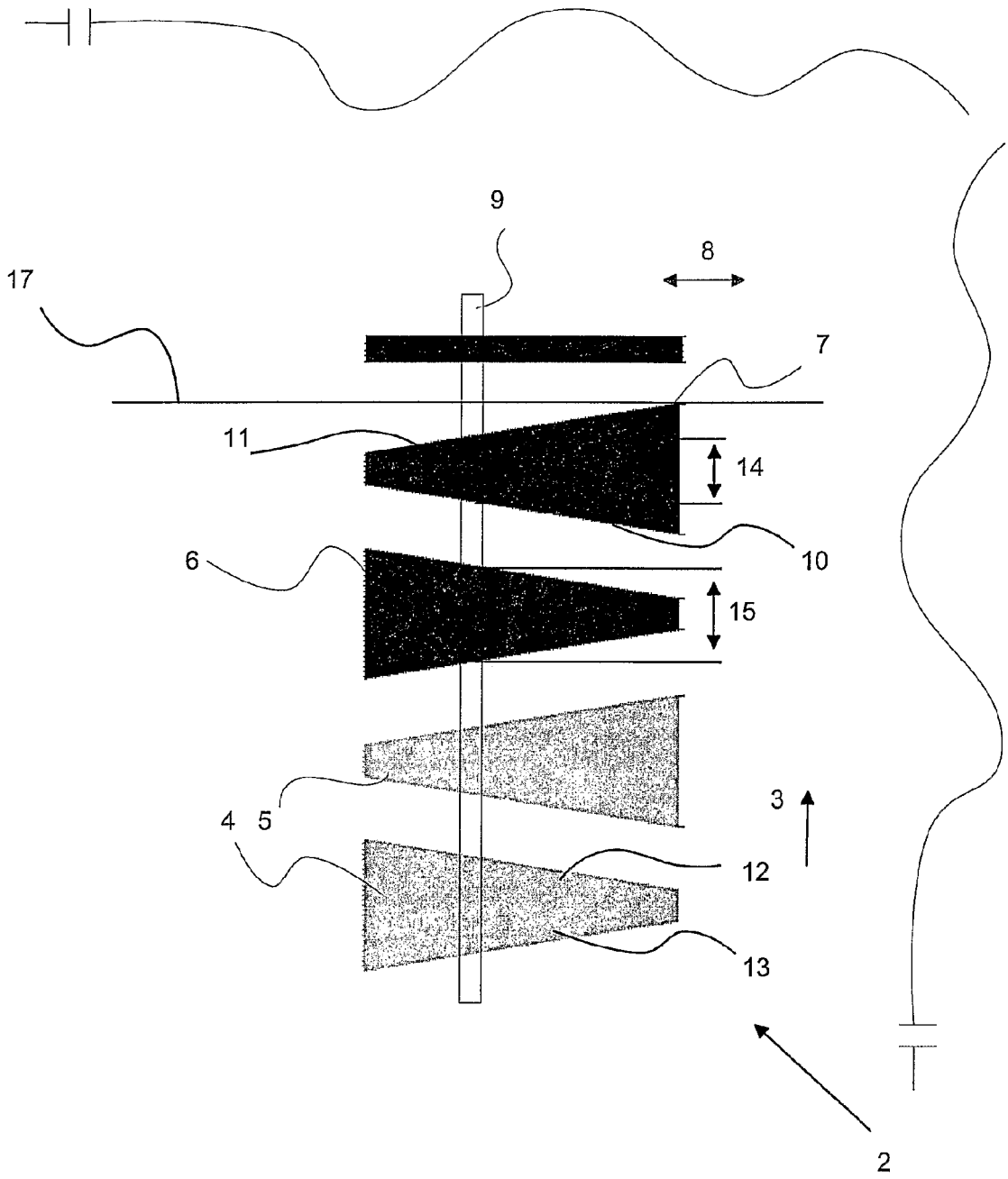
FIG. 1 shows register marks according to an embodiment.

The attached drawings are for purposes of illustration and are not necessarily to scale.

DETAILED DESCRIPTION OF THE INVENTION

If a front edge and a rear edge, respectively, of a register mark are detected with the greatest possible accuracy, a focus or a center of the register mark can be determined. Furthermore, it can be detected whether the register mark is shifted transversely to the transport direction of the printing material, i.e., relative to said mark's set position, if, for example, the distance between the front edge and the rear edge varies in this direction and, for example, increases or decreases. By determining the distance in the inventive manner, i.e., the width of the register mark in the region of the used sensor along the traveled distance of the transport belt, a uniform printing material transport speed is not required in order to determine deviations of the actual positions of the register marks from the set position in a direction transverse to the transport direction of the printing material. To accomplish this, in particular, the region in which the used detector is active, is dimensionally very small. The width of the senor in the direction perpendicular to the transport direction should preferably be approximately the width of 5 pixels, i.e., five times the width of the smallest structures created by the imaging devices on the printing material. It is also possible that the width of the sensor corresponds to only one pixel.

In accordance with the invention, an increasing or decreasing width of a register mark is achieved in that the front edge and the rear edge of a register mark are arranged at an angle relative to the direction perpendicular to the transport direction of the printing material, and include an angle greater than zero with this scanning direction. In particular, unequal angles can be used to achieve a width decrease or increase. As a result of the distance passed by the transport belt between the detection of the front edge and the rear edge of the register mark, the position assumed by the register mark relative to the sensor can be determined in this manner. Based on this known position, the color separation can thereafter be shifted accordingly, or the imaging device creating the color separation may be set up accordingly. In so doing, a shift of the color separation means that the positions of the image elements to be produced on the printing material are shifted accordingly. If only the register marks are to be seen, it is also possible to shift only the positions of the register marks. To achieve this, the imaging device can be actuated in a time-shifted manner, for example, or its position can be reset. Deviations from the center can be detected better in that the signal-to-noise ratio of the sensor is improved due to this design of the register mark.

In a particularly advantageous embodiment, the angle of inclination of the front edge and the rear edge of the register marks with opposing signs may be of the same degree, preferably approximately 15 degrees. In this manner, it can be easily ensured that the distances of the front edge and the rear edge relative to each other always decrease or increase. In so doing, an angle of approximately 15 degrees can be easily detected. It is also possible to detect a front edge or rear edge above; so that the inclination increases or decreases relative to the scanning direction. In so doing, the scanning direction is the direction which extends perpendicular to the transport direction of the printing material as already described above.

In accordance with the invention, positions of register marks assigned to one color separation are to be detected. In so doing, the position of the register marks relative to a fixed point, preferably the sensor, is to be determined. Preferably, this is achieved in that, for each color separation, two successive equal register marks rotated relative to each other by 180 degrees are formed at a distance from each other in transport direction of the printing material. Should the color separation deviate from its set position in such a manner that the two register marks do not pass under the sensor at a predetermined position, then, in a simple manner, the difference of the measured widths of the register marks can be detected in accordance with the invention. In particular, one feature may provide that a zero position of the register marks, and thus of the color separations as well, is defined in that the widths of the register marks that are rotated relative to each other by 180 degrees are in fact identical. Advantageously in fact, the detection of the equal widths of the register marks in the region of the sensor allows the conclusion that the register marks are in the zero position, i.e., the color separations are in the preferred region of the sensor. If, as in this case, different widths exist, it may be concluded that an error position of the color separations exists. Inasmuch as only the widths of the error marks are compared, error measurements based on enlargements, e.g., caused by optical errors of the imaging devices, advantageously, need not be expected.

Therefore, the invention further provides that the widths of two successive register marks having the same color are detected, that a difference of the measured widths is determined and that, depending on the sign and amount of the difference, the zero position or the alignment of the imaging device used for this color separation is shifted by a shift S. In this manner, during another method step, the actual position of the color separation can at least be adapted to its set position. In so doing, the shift S is to be adapted to the measured difference in such a manner that, during a subsequent step, during which the shifted register mark is to be applied to the printing material, the position of the zero position of the register marks is at least closer to the region of the sensor. To achieve this, the register marks may be applied by the imaging device at an appropriate new position of the printing material, without requiring a new alignment or a shifting of the imaging device; this represents a strictly logical shifting of the register marks.

In accordance with the invention, the shift S value is composed of the quotient of the difference of the measured widths and a number H, where H is selected such that S may amount to at most half of the expansion of a register mark in a direction perpendicular to the transport direction of the printing material.

A modification of the invention provides that the imaging devices having zero positions or alignments that have already been shifted k times, will apply new register marks to the printing material and, depending on the difference of the detected widths of the register marks, the zero positions or alignments of the imaging devices are shifted by a shift $S_K$, and this procedure is carried out iteratively until the shift $S_K$ approaches zero and a calibrated zero position or alignment of the imaging device is set. By using this iterative operation, the zero position of the register marks can be shifted rapidly into the region of the sensor.

In order to accelerate this iterative operation or to at least to shift the distances of the zero positions of the register marks ever closer into the sensor region, it may be advantageous that the shift $S_K$ is composed of the quotient of the difference and a number $H_K$, where $H_K$ is selected such that $S_K$ may be at most half of the expansion of a register mark in scanning direction. In so doing, K represents a characteristic number of the iteration process and indicates the number of already performed passes; and $H_K$ may assume a different value during each pass.

Another modification provides that $H_{K+1}$ is smaller than $H_K$, so that the shift $S_K$ becomes k smaller during each iterative step. In this manner, the shifts $S_K$ become progressively finer from one iteration step to the next.

A particularly advantageous embodiment provides that, initially, a calibrated zero position or alignment of a reference imaging device for a reference color separation is preferably set on black and, to do so, a necessary total shift $S_G$ is determined.

In this manner, for example, the color separation for the color black can be shifted in such a manner that the zero positions of their associate register marks are inside the region of the sensor. If shift $S_G$ for this is known, it is possible to reverse this shift and to return the color separation into its original position.

Furthermore, the invention advantageously provides that, considering the remaining imaging devices, calibrated zero positions or alignments are adjusted and, to do so, the necessary total shifts $S_G'$, $S_G''$, $S_G'''$, etc. are determined. These imaging devices, for example, may produce color separations having the CMY colors, where C represents cyan, M represents magenta and Y represents yellow. However, other colors are also possible, in particular RGB (red, green, blue) colors, i.e., alternatively as well as additionally.

In this manner, it is possible that each color separation assumes a position relative to the sensor region and relative to a preferred reference color separation, so that no deviations of color separations occur in a direction perpendicular to the transport direction of the printing material.

Another modification provides that, respectively, the difference $\Delta S_G'(" \ldots )$ of the total shifts $S_G'$, $S_G''$, $S_G'''$, etc., relative to the total shift $S_G$ of the reference color separation are determined, respectively, that the total $S_G$ of the reference imaging device is reversed and that the remaining imaging devices or the positions of the color separations are shifted by the difference $\Delta S_G'(" \ldots )$. In this manner, each color separation is applied superimposed in a registered manner in a direction perpendicular to the transport direction of the printing material, and the positions of the imaging devices are adjusted relative to the original position of the imaging device which applies the color separation of the reference color, preferably black. Generally, this prevents large shifts of the imaging devices.

One embodiment is shown by the attached drawing, whereby the scope of the invention is not intended to be restricted thereto, and whereby additional inventive features may result.

A printing material 2 is transported in the direction of arrow 3 by not illustrated transport elements. Register marks 4, 5 and 6, 7 have been applied to the printing material by imaging devices not illustrated here. Register marks 6, 7 are shown in black here and represent register marks 6, 7 of reference color black. However, also another color may be used. Register marks 4, 5 here have the color cyan. The color selection refers to a simplified example; in particular, it is possible to apply additional register marks in additional colors to printing material 2.

Printing material 2 is transported in direction 3 under a stationary sensor, which is not illustrated. This sensor scans a region 9 of the printing material. In this region 9, the front edges 11 and 12 and the rear edges 10 and 13 of register marks 4, 5, 6 and 7 are detected. Edges 11, 12 and 10, 13 extend in an inclined manner relative to a horizontal 17 which is not printed. Horizontal 17 extends in a direction perpendicular to transport direction 3. Register marks 4 and 7 are applied as filled triangles without points, whereby register mark 5 is rotated by 180 degrees relative to register mark 4, and register mark 6 is rotated by 180 degrees relative to register mark 7.

The distance traveled by the printing material in direction 3 between the detection of the front edge 11, 12 and of the rear edge 10, 13 is measured. This is achieved, in particular, by a not illustrated encoder which measures the advance of a not illustrated transport belt. By using the thusly measured path, the widths 14 and 15 of register marks 1 through 7 in region 9 are determined.

During a first step, the widths 14, 15 of the black register marks 6, 7 are measured by the sensor in region 9. If the widths 14 do not correspond, their difference Z is determined. Depending on the sign of Z and the amount, the position, at which register marks 6, 7 are applied, is further advanced in the direction 8 into the vicinity of the sensor by an amount S. This advance S may be computed, for example, based on the quotient of the difference Z and a number H, where H, for example, may correlate with half the height, the so-called traverse, of a register mark 4 through 7.

During a subsequent step, register marks 6, 7 for black are applied again, this time with the shifted positions, to printing material 2. Again, widths 14, 15 are determined and, if the difference is not zero, the positions of register marks 6, 7 are shifted again in direction 8 in the direction of the sensor. This operation is repeated in an iterative manner until difference Z is equal to zero or close to zero. Then, register marks 6, 7 are located in zero position under the sensor. To accomplish this, said marks are shifted by a total shift of $S_G$.

During a subsequent step, the same operation is repeated for the next color, in this example cyan (C). The zero position of register marks 4 and 5 of the color cyan is achieved over the total shift $S_G'$.

During additional steps, the operation is repeated for the colors magenta (M) and yellow (Y). The register marks for these colors are not shown here. The zero positions are achieved over the total shifts $S_G''$, $S_G'''$.

A now following printing operation provides that the positions of the color separations for the colors CMY are shifted in such a manner that their color separations are on top of the black color separation. In so doing, these shifts may be strictly logical shifts. However, the invention may also provide that the alignments or positions of the imaging devices can be reset appropriately.

In so doing, the position of the black color separation corresponds to its original position; no position changes based on the performed operation need be made. The remaining colors are calibrated with respect to the black color separation in that they are shifted by the differences $\Delta S_G'$, $\Delta S_G''$ and $\Delta S_G'''$ between the total shifts of the register marks of the colors CMY relative to the register marks 6 and 7 of the color black. In this simple manner, color separations can bet aligned in a direction transverse to transport direction 3 of the printing material.

Figure 2:
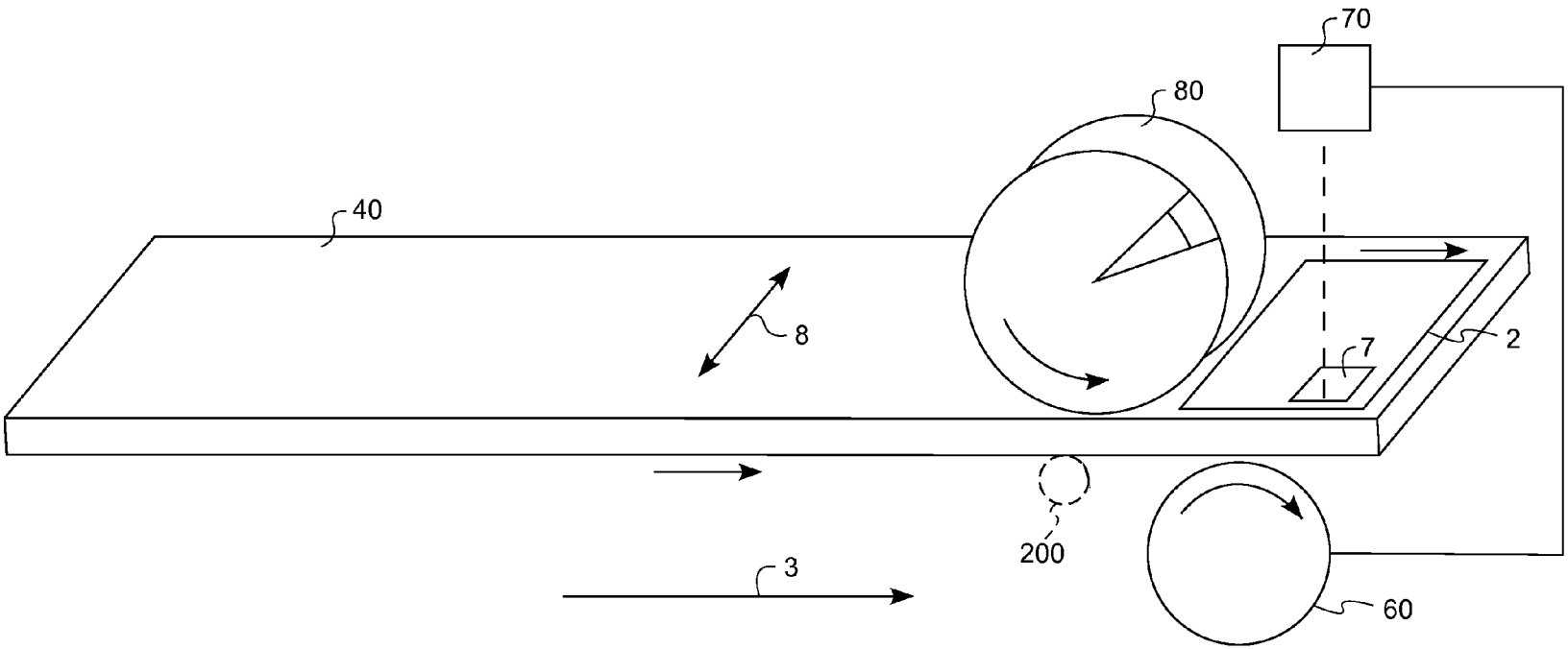
FIG. 2 is a schematic of a device according to an embodiment for detecting and correcting chromatic aberrations with a transport belt driven by a control device, and with applied register marks that are scanned by a sensor device.

FIG. 2 shows a schematic drawing of a section of a transport belt 40 of a printing apparatus for multicolor printing. Printing material 2, transport direction 3, register mark 7, and direction 8 are as shown in FIG. 1. Transport belt 40 is a continuous belt, illustrated in a planar fashion here, and is transparent. Printing drum 80 represents the imaging device for a certain color separation. Other imaging devices, of which there are normally three additional for four-color printing, are not shown. Register mark 7 (FIG. 1) is applied to printing material 2. Other register marks are also applied to printing material 2, as discussed above with reference to FIG. 1. Register mark 7 is scanned by a sensor device 70 arranged above the transport belt 40. The transport belt 40 is driven by a control device 60.

The control device 60 in FIG. 1 is rotated in the direction of the curved arrow. Control device 60 is connected with sensor device 70 and drives transport belt 40. The surface of the printing drum 80 receives an image of a color separation formed by electrostatic forces on toner so as to remain on the surface of the printing drum 80, usually magenta, cyan, yellow or key, which developed color separation image is transferred to printing material 2.

Sensor device 70 uses optical signals (e.g., light, represented in FIG. 1 by a dashed line) to measure register mark 7 and receives reflected optical signals back from register mark 7. The configuration of register mark 7 (and other register marks) is described above with reference to FIG. 1. Sensor device 70 is configured so that the light/dark transition of the register marks to the transport belt 40 can be determined. Sensor device 70 uses encoder pulses from encoder 200 to calculate the corresponding distance or interval covered by register mark 7.

Encoder 200 measures the distance traveled by the printing material 2 in direction 3, i.e., the advance of transport belt 40. Encoder 200 can include a controller adapted to correlate optical pulses and the diameter of the encoder wheel in encoder 200 to the advance of transport belt 40, or an optical sensor measuring a pattern printed on transport belt 40, as is known to those skilled in the art.

The invention claimed is:

1. Method for aligning color separations of a printing image to each other on a printing material, the color separations being produced on the printing material by respective imaging devices, the printing material transported by a transport belt along a transport path past the respective imaging devices, the color separations being aligned in a first direction perpendicular to a transport direction of the printing material, the method comprising:

applying two equal register marks to the printing material for each color separation using corresponding imaging device, the two equal register marks rotated by 180 degrees relative to each other and spaced at a distance from each other in the transport direction of the printing material, each register mark including a front and a rear edge arranged at respective angles of inclination greater than zero relative to the first direction;

detecting a respective front edge and a respective rear edge of each applied register mark using a sensor;

determining respective widths of the two equal register marks of a selected one of the color separations by measuring, using an encoder, an advance of the transport belt between a detection of the front edge of each register mark and a detection of the rear edge of that register mark;

determining positions of the two equal register marks of the selected color separation in the first direction using the determined respective widths and the respective angles of inclination of the front and rear edges; and determining and correcting misalignments of the imaging device used for the selected color separation, the determining and correcting misalignments including determining a difference Z of the determined respective widths, and, depending on a sign and a magnitude of the difference Z, shifting a zero position or an alignment of the imaging device used for the selected color separation by a shift S.

2. Method as in claim 1, wherein the respective angles of inclination of the respective front and rear edges of each register mark have the same magnitude.

3. Method as in claim 1, wherein the shift S is determined based on a quotient of the difference Z of the determined respective widths and a number H, wherein H is selected so that S can be at most half of expansion of one register mark in the first direction.

4. Method as in claim 1, further including, after the respective imaging devices having zero positions or alignments have already been shifted k times, applying new register marks to the printing material and, depending on the difference Z of the determined respective widths of the applied new register marks, shifting the zero positions or the alignments of the respective imaging devices by a shift $S_k$, and repeating this operation until the shift $S_k$ approaches zero and a calibrated zero position or alignment of the respective imaging device has been set.

5. Method as in claim 4, wherein the shift $S_k$ is determined based on a quotient of the difference Z of the determined respective widths and a number $H_k$, where $H_k$ is selected such that $S_k$ may be at most half of an expansion of a register mark in the first direction.

6. Method as in claim 5, wherein $H_{k+1}$ is smaller than $H_k$, so that the shift $S_k$ becomes k smaller during each iterative step.

7. Method as in claim 1, further comprising selecting a reference imaging device and remaining imaging devices from the respective imaging devices, initially determining a calibrated zero position or an alignment of the reference imaging device for a reference color separation, and determining a total shift $S_G$ required therefor.

8. Method as in claim 7, further comprising setting calibrated zero positions or alignments for the remaining imaging devices, and determining respective total shifts required therefor.

9. Method as in claim 8, further comprising determining respective differences of the respective total shifts of the remaining imaging devices relative to the total shift $S_G$ of the reference color separation, wherein the total shift $S_G$ of the reference imaging device is reversed, and the remaining imaging devices or positions of the color separations are shifted by the determined respective differences.

10. Method as in claim 7, wherein the reference color separation is black.

11. Method as in claim 1, wherein the angles of inclination of the front edge and rear edge of the register marks, with opposing signs, are approximately 15 degrees.

* * * * *